US007306043B2

(12) United States Patent
Toekje et al.

(10) Patent No.: US 7,306,043 B2
(45) Date of Patent: Dec. 11, 2007

(54) SYSTEM AND METHOD TO CONTROL MULTIPLE TOOLS THROUGH ONE CONTROL LINE

(75) Inventors: Jarle Toekje, Straume (NO); Timo Jokela, Stavanger (NO); Ian Raw, Stavanger (NO); Jennifer E. Trittschuh, Paradis (NO); Jason K. Jonas, Missouri City, TX (US); Donald W. Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 356 days.

(21) Appl. No.: 10/904,091

(22) Filed: Oct. 22, 2004

(65) Prior Publication Data

US 2005/0087344 A1 Apr. 28, 2005

Related U.S. Application Data

(60) Provisional application No. 60/514,028, filed on Oct. 24, 2003.

(51) Int. Cl.
*E21B 34/10* (2006.01)

(52) U.S. Cl. ..... 166/375; 166/319; 166/320

(58) Field of Classification Search ..... 166/375, 166/374, 319, 331, 381, 387, 320
See application file for complete search history.

(56) References Cited

U.S. PATENT DOCUMENTS 3,420,270 A 1/1969 Neyer
3,894,560 A 7/1975 Baugh
3,993,100 A 11/1976 Pollard et al.
4,036,247 A 7/1977 Baugh
4,185,541 A 1/1980 Milberger et al.
4,308,884 A 1/1982 Hoerger et al.
4,334,581 A 6/1982 Arendt
4,378,848 A 4/1983 Milberger
4,442,902 A 4/1984 Doremus et al.
4,467,833 A 8/1984 Satterwhite et al.
4,549,578 A 10/1985 Hibbs et al.
4,636,934 A 1/1987 Schwendemann et al.
4,942,926 A 7/1990 Lessi
4,945,995 A 8/1990 Tholance et al.
5,156,210 A 10/1992 Roth
5,238,070 A 8/1993 Schultz et al.
5,529,126 A * 6/1996 Edwards ..... 166/331
5,832,996 A 11/1998 Carmody et al.
6,109,357 A 8/2000 Zimmerman
6,125,938 A 10/2000 Garcia-Soule et al.

(Continued)

FOREIGN PATENT DOCUMENTS

GB 1505496 A 3/1978

(Continued)

*Primary Examiner*—David Bagnell
*Assistant Examiner*—David Andrews
(74) *Attorney, Agent, or Firm*—Trop, Pruner & Hu, P.C.; Dona C. Edwards; Bryan P. Galloway

(57) ABSTRACT

The invention is a system and method a system used to control multiple downhole tools with one control line. The downhole tools may comprise any hydraulically actuated tools, such as valves, packers, or perforating guns. Each tool is associated with an indexer, in one embodiment, so that the tools can be operated in concert and as a system.

33 Claims, 5 Drawing Sheets

U.S. PATENT DOCUMENTS

| | | | | |
|---|---|---|---|---|
| 6,247,536 | B1 | 6/2001 | Leismer et al. | |
| 6,308,783 | B2 | 10/2001 | Pringle et al. | |
| 6,470,970 | B1 | 10/2002 | Purkis et al. | |
| 6,491,102 | B2 | 12/2002 | Leismer et al. | |
| 6,502,640 | B2 | 1/2003 | Rayssiguier et al. | |
| 6,505,684 | B2 | 1/2003 | Rayssiguier et al. | |
| 6,523,613 | B2 | 2/2003 | Rayssiguier et al. | |
| 6,575,237 | B2 | 6/2003 | Purkis et al. | |
| 6,585,051 | B2 | 7/2003 | Purkis et al. | |
| 6,644,412 | B2 | 11/2003 | Bode et al. | |
| 6,668,936 | B2 | 12/2003 | Williamson, Jr. et al. | |
| 6,761,222 | B2 | 7/2004 | Wilson | |
| 7,059,401 | B2 | 6/2006 | Bode et al. | |
| 2002/0046845 | A1 | 4/2002 | Rayssiguier et al. | |
| 2002/0053438 | A1* | 5/2002 | Williamson, Jr. | 166/373 |
| 2002/0066574 | A1 | 6/2002 | Leismer et al. | |
| 2003/0221829 | A1 | 12/2003 | Patel et al. | |
| 2005/0087344 | A1 | 4/2005 | Toekje et al. | |

FOREIGN PATENT DOCUMENTS

| | | | |
|---|---|---|---|
| GB | 2355748 | A | 5/2001 |
| GB | 2359833 | A | 9/2001 |
| GB | 2366817 | A | 3/2002 |
| GB | 2376055 | A | 12/2002 |
| GB | 2398805 | * | 1/2004 |
| RU | 2710813 | | 7/2001 |
| RU | 2204701 | C2 | 5/2003 |
| SU | 1535970 | A1 | 1/1990 |
| WO | WO98/09055 | A1 | 3/1998 |
| WO | WO 98/39547 | A2 | 9/1998 |
| WO | WO98/50681 | A1 | 11/1998 |
| WO | WO99/47790 | A1 | 9/1999 |
| WO | WO01/86113 | A1 | 11/2001 |
| WO | WO02/20942 | A1 | 3/2002 |
| WO | WO02/29205 | A1 | 4/2002 |

* cited by examiner

*FIG. 2*

| PRESSURE CYCLE | 1 | 2 | 3 | 4 | 5 | 6 | 7 | 8 |
|---|---|---|---|---|---|---|---|---|
| VALVE 1 | ON | ON | ON | ON | OFF | OFF | OFF | OFF |
| VALVE 2 | ON | ON | OFF | OFF | ON | ON | OFF | OFF |
| VALVE 3 | ON | OFF | ON | OFF | ON | OFF | ON | OFF |

*FIG. 3*

| PRESSURE CYCLE | 1 | 2 | 3 | 4 | 5 | 6 | 7 | 8 | 9 |
|---|---|---|---|---|---|---|---|---|---|
| VALVE 1 | ON | ON | ON | INT1 | INT1 | INT1 | OFF | OFF | OFF |
| VALVE 2 | ON | INT1 | OFF | ON | INT1 | OFF | ON | INT1 | OFF |

*FIG. 4*

| PRESSURE CYCLE | 1 | 2 | 3 | 4 | 5 | 6 | 7 | 8 | 9 | 10 | 11 | 12 |
|---|---|---|---|---|---|---|---|---|---|---|---|---|
| VALVE 1 | ON | ON | ON | ON | ON | ON | OFF | OFF | OFF | OFF | OFF | OFF |
| VALVE 2 | ON | ON | ON | OFF | OFF | OFF | ON | ON | ON | OFF | OFF | OFF |
| VALVE 3 | ON | INT1 | OFF | ON | INT1 | OFF | ON | INT1 | OFF | ON | INT1 | OFF |

*FIG. 5*

| PRESSURE CYCLE | 1 | 2 | 3 | 4 | 5 | 6 |
|---|---|---|---|---|---|---|
| VALVE 1 | ON | OFF | ON | OFF | ON | OFF |
| VALVE 2 | ON | INT1 | OFF | ON | INT1 | OFF |

*FIG. 6*

| PRESSURE CYCLE | 1 | 2 | 3 | 4 | 5 | 6 | 7 | 8 | 9 | 10 |
|---|---|---|---|---|---|---|---|---|---|---|
| VALVE 1 | ON | OFF | ON | OFF | ON | OFF | ON | OFF | ON | OFF |
| VALVE 2 | ON | INT1 | INT2 | INT3 | OFF | ON | INT1 | INT2 | INT3 | OFF |

*FIG. 7*

| PRESSURE CYCLE | 1 | 2 | 3 | 4 | 5 | 6 | 7 | 8 | 9 | 10 | 11 | 12 |
|---|---|---|---|---|---|---|---|---|---|---|---|---|
| VALVE 1 | ON | INT1 | OFF | ON | INT1 | OFF | ON | INT1 | OFF | ON | INT1 | OFF |
| VALVE 2 | ON | INT1 | INT2 | OFF | ON | INT1 | INT2 | OFF | ON | INT1 | INT2 | OFF |

SYSTEM AND METHOD TO CONTROL MULTIPLE TOOLS THROUGH ONE CONTROL LINE

This application claims benefit of priority from U.S. Provisional Application No. 60/514,028, filed Oct. 24, 2003 and entitled System and Method to Control Multiple Tools Through One Control Line, which is incorporated by reference herein.

BACKGROUND

Field of Invention. The present invention relates to the field of downhole tools used in a subterranean wellbore. More specifically, the invention relates to a system and method which enables the control of multiple tools deployed in such a wellbore with the use of only one hydraulic control line.

It is common to deploy hydraulic control lines in subterranean wellbores, such as oil wells, in order to control downhole equipment. Packers, valves, and perforating guns are some of the downhole tool types that can be controlled by changes in pressure in the fluid contained in the hydraulic control lines. In some prior art systems, multiple control lines are deployed in the wellbore to control multiple downhole tools. Typically the top end of each control line extends to the surface (land or sea floor) and is connected to a hydraulic pump that can control the pressure of the fluid inside the line.

A control line must be passed through a feedthrough of a packer in order to extend the control line from the top to the bottom of the packer (or across the packer). Among others, a function of a packer is to seal the wellbore annulus across the packer. However, each time a control line is extended through a feedthrough, a potential leak path is created in the packer potentially allowing the seal created by the packer to fail. Therefore, the prior art would benefit from a system that decreases the number of control lines necessary to control multiple downhole tools.

Thus, there is a continuing need to address one or more of the problems stated above.

SUMMARY

The invention is a system and method used to control multiple downhole tools with one control line. The downhole tools may comprise any hydraulically actuated tools, such as valves, packers, or perforating guns. Each tool is associated with an indexer, in one embodiment, so that the tools can be operated in concert and as a system.

Advantages and other features of the invention will become apparent from the following drawing, description and claims.

BRIEF DESCRIPTION OF THE DRAWINGS

The manner in which these objectives and other desirable characteristics can be obtained is explained in the following description and attached drawings in which:

FIGS. 2-7 illustrate possible combinations of valves and permutations thereof utilizing the present invention.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

The system 5 of the present invention will be specifically described below such that the relevant control line controls the operation of flow control devices and/or packers of a wellbore. However, it should be understood that the system 5 can control the operation of any hydraulically actuated downhole tool 6, including but not limited to flow control devices, packers, perforating guns, safety valves, pumps, gas lift valves, anchors, bridge plugs, and sliding sleeves. Moreover, by using the present invention, any combination of downhole tools may be connected and controlled with the same control line.

Figure 1:
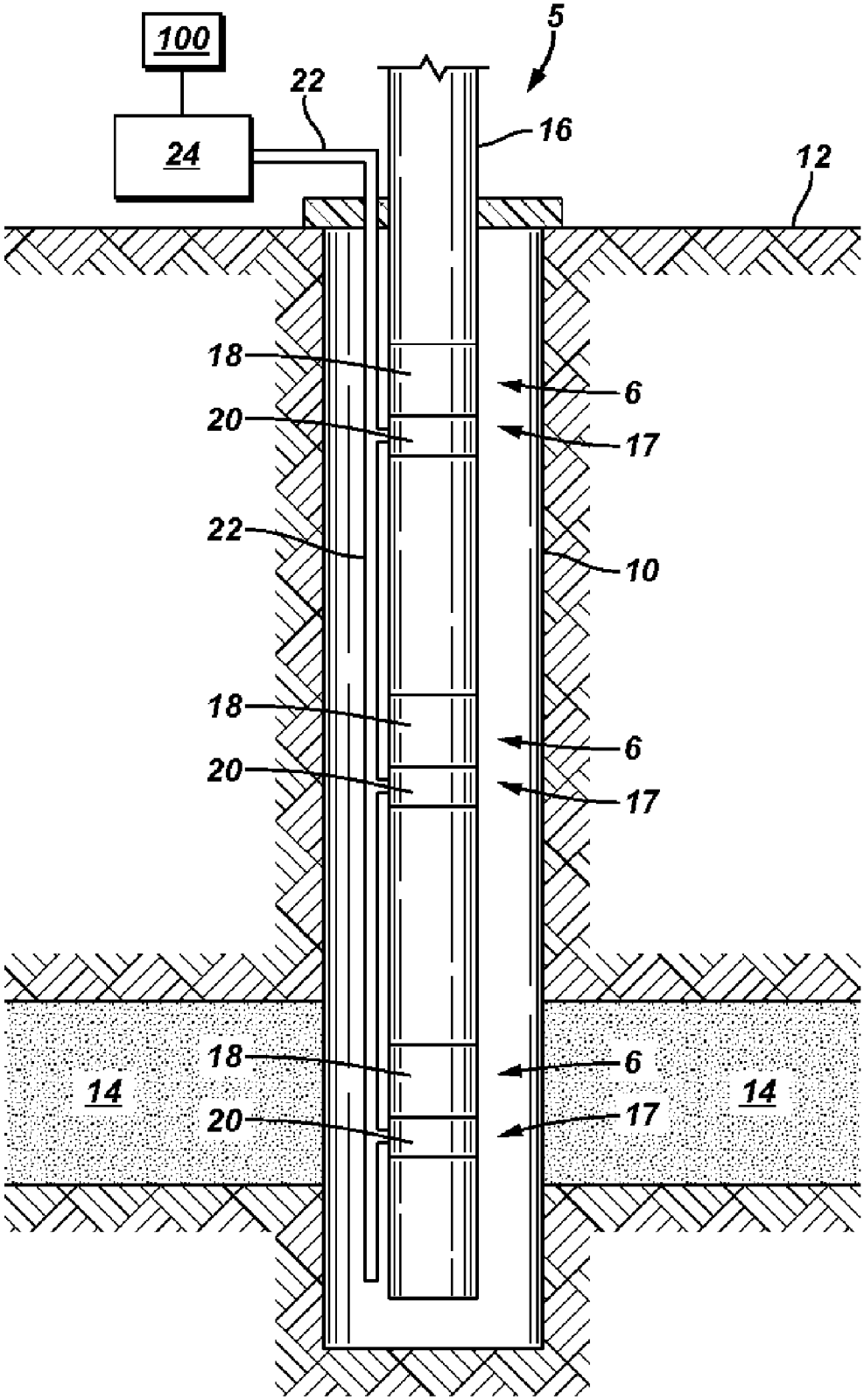
FIG. 1 illustrates an embodiment of the present invention.

FIG. 1 illustrates the present invention. A wellbore 10 extends from the surface 12 into the earth and intersects at least one formation 14. The wellbore 10 can be a land well or a subsea well, wherein the surface 12 corresponds to the bottom of the ocean or sea, or a platform well. Wellbore 10 may be cased. Tubing 16 is deployed within wellbore 10. Tubing 16 can comprise production tubing, coiled tubing, drill pipe, or any other apparatus for conveyance used in subterranean wells. A plurality of valve systems 17 are deployed on the tubing 16. Each valve system 17 comprises a flow control device 18 disposable downhole, such as a sleeve valve, a ball valve, a disc valve, a choke, a variable orifice valve, or an in-line valve. Each valve system 17 also comprises an indexer 20 that is associated with its corresponding flow control device 18. A hydraulic control line 22 is deployed in the wellbore 10 and is typically connected to and deployed together with the tubing 16. The control line 22 is hydraulically connected to each indexer 20. A hydraulic pressure source 24, which may be a discrete or variable setting source, feeds the control line 22.

As known in the art and depending on whether wellbore 10 is an injector or producer, fluids (such as water, steam, frac fluids, or treatment fluids) are either injected from surface 12 through tubing 16 through at least one open valve system 17 and into formation 14 or fluids (such as water, hydrocarbons, oil, or gas) are produced from the formation 14 through at least one open valve system 17 into tubing 16 and up to surface 12. Artificial lift equipment, such as pumps or gas lift systems, may aid in the injection or production of the relevant fluids.

A change in pressure or a pressure cycle in the control line 22 induced by the source 24 produces an actuation in each indexer 20. As is known in the art, an actuation in each indexer 20 may activate, deactivate, or change the setting of the corresponding flow control device 18, depending on the construction and configuration of the relevant indexer 20 and flow control device 18. In the present invention, the indexers 20 are constructed and configured so that they function in concert or together so as to provide a different permutation of settings of the plurality of the flow control devices 18 for each pressure change or cycle induced in the control line 22. A user can thereby control the valve systems 17 as a system to select his/her desired permutation of settings for each of the flow control devices 18.

For instance, FIG. 2 shows a possible set of permutations for three flow control devices 18, such as the valves shown in FIG. 1, assuming that such valves are on/off valves (two settings—fully open or "On" and fully closed or "Off"). As can be seen in FIG. 2, there are eight possible permutations for three valves wherein each of the valves has two settings (i.e. on/off valves). As shown in FIG. 2, in the first pressure change or actuation, each of the Valves 1, 2, and 3 is in its "On" setting. In the second pressure change or actuation, Valves 1 and 2 are in the "On" setting and Valve 3 is in the "off" setting. In the third change or actuation, Valves 1 and 3 are in the "on" setting and Valve 2 is in the "off" setting. The remainder of the permutations are clear from the Figure.

FIGS. 3-7 show other possible combinations of valves and permutations thereof. FIG. 3 shows a possible set of permutations and pressure changes or cycles for a two valve combination, wherein each of Valve 1 and Valve 2 has three settings: [1] a fully open setting ("On"), [2] an intermediate, partially open setting ("Int 1"), and [3] a fully closed setting ("Off"). FIG. 4 shows a possible set of permutations and pressure changes or cycles for a three valve combination, wherein Valve 1 and Valve 2 have two settings each ("On" and "Off) and Valve 3 has three settings ("On", "Int 1", and "Off"). FIG. 5 shows a possible set of permutations and pressure changes or cycles for a two valve combination, wherein Valve 1 has two settings ("On" and "Off) and Valve 2 has three settings ("On", "Int 1", and "Off"). FIG. 6 shows a possible set of permutations and pressure changes or cycles for a two valve combination, wherein Valve 1 has two settings ("On" and "Off") and Valve 2 has five settings ("On", "Int 1", "Int 2", "Int 3", and "Off"). The "Int 2" and "Int 3" settings are partially open settings other than "Int1." FIG. 7 shows a possible set of permutations and pressure changes or cycles for a two valve combination, wherein Valve 1 has three settings ("On", "Int 1", and "Off") and Valve 2 has four settings ("On", "Int 1", "Int 2", and "Off").

It is understood that the actual settings for each valve can be varied from those described above, depending on the completion, wellbore, and desires of the user. For instance, the indexers can be constructed and configured so that the permutations of any of the Figures are rearranged (i.e. permutation 1 in any of the Figures can take the place of any of the other permutations in the same Figure and vice versa). Or, the indexer for one or more of the valves can be constructed and configured so that its setting changes only a limited number of times per total number of pressure changes or cycles. Moreover, any of the settings for the valves can be anything from fully open to fully closed, including any percentage of partially open. A user constructs and designs the valves and indexers so as to provide him/her with the desired permutation of settings at the desired pressure change or actuation.

With the use of the present invention, an operator can thus select the permutation of settings he/she desires for a group of valves by use of a single control line.

Figure 8:
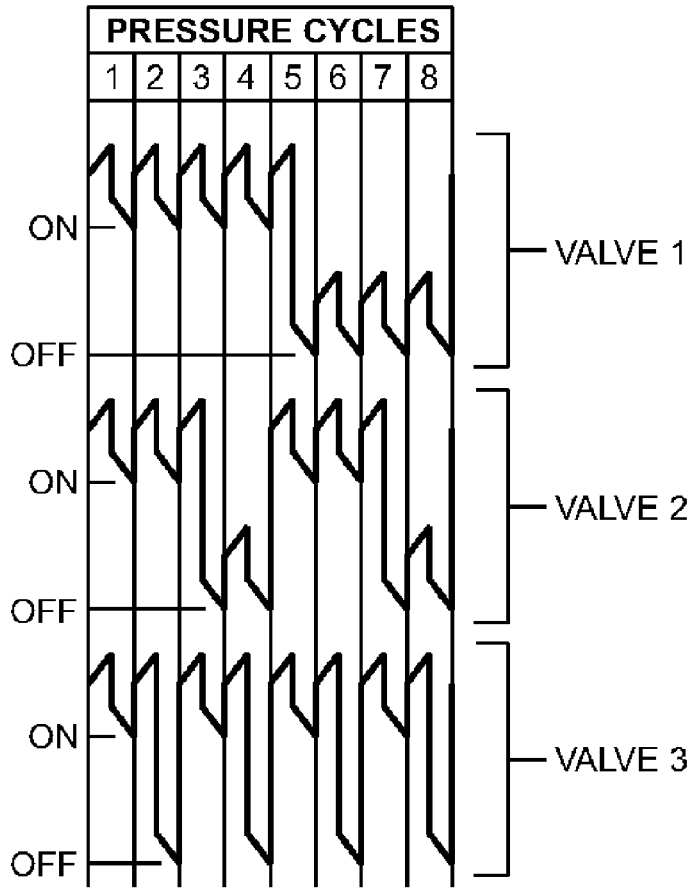
FIG. 8 illustrates the indexer slot configuration for the indexers of the system of valves described in relation to FIG. 2
Figure 9:
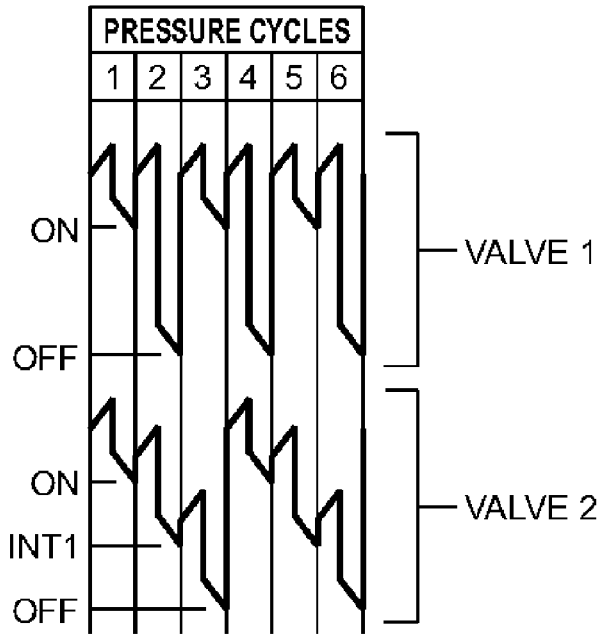
FIG. 9 illustrates the indexer slot configuration for the indexers of the system of valves described in relation to FIG. 5.

The operation of an indexer and its functional connection to a flow control device is known in the art. Examples of such operation can be found in U.S. Pat. Nos. 6,276,458, 6,328,109, and 6,494,264 (each of which is incorporated herein and is owned by the assignee of the present invention). The indexer slot configuration for each of the valves depends on the valve settings, combinations, and permutations desired by the user. For example, FIG. 8 shows the indexer slot configurations for the indexers of the system of valves described in relation to FIG. 2, and FIG. 9 shows the indexer slot configurations for the indexers of the system of valves described in relation to FIG. 5.

Figure 10:
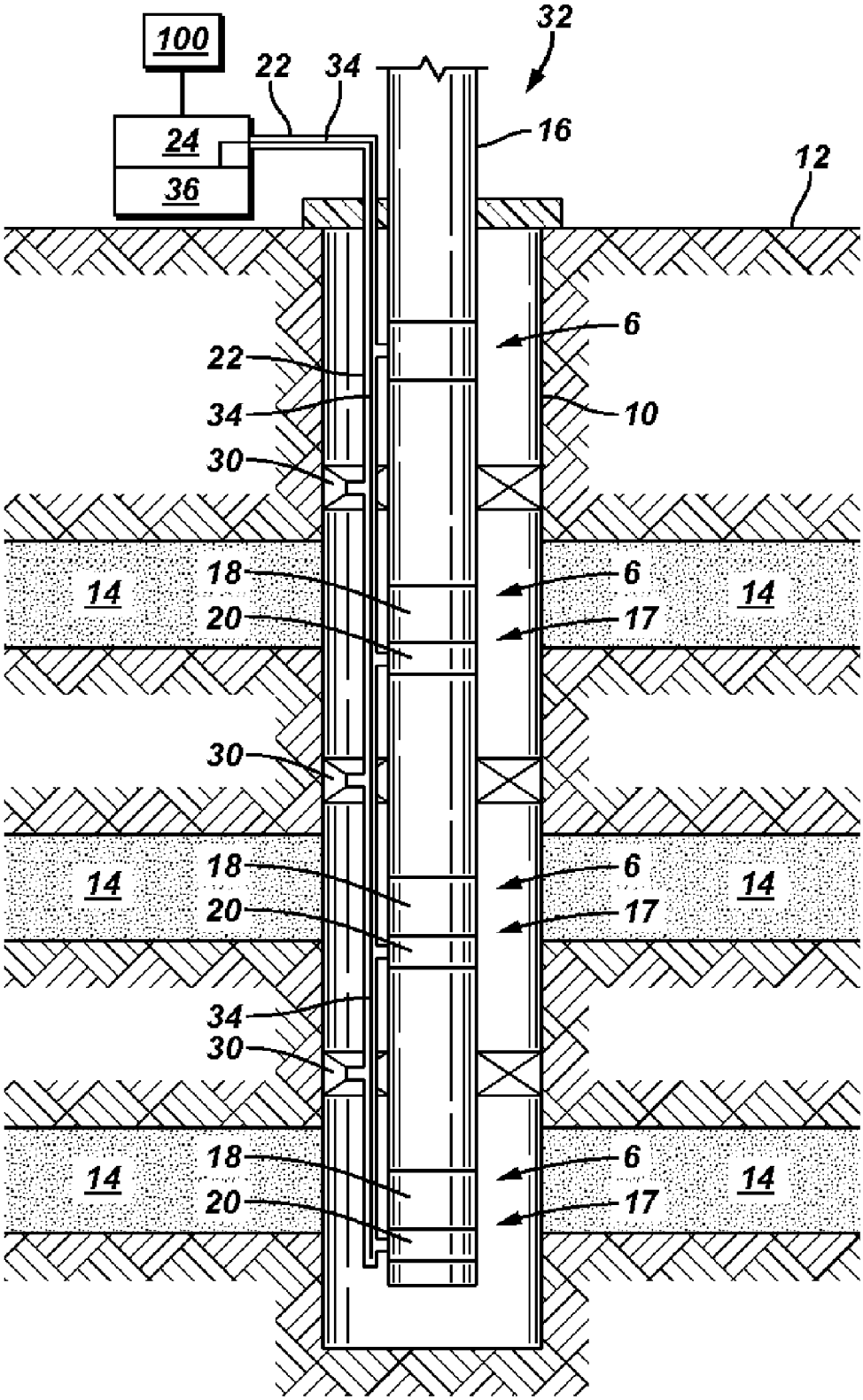
FIG. 10 illustrates another embodiment of the present invention.

FIG. 10 shows another embodiment of the present invention. In this embodiment, at least one packer 30 is deployed on tubing 16. Packer 30 is run deactivated (unset) into the wellbore 10 on the tubing 16. When the system is in place, packer 30 is activated (set) expanding and forming a seal against the interior of the wellbore 10 thereby isolating the area therebelow from the area thereabove. In this embodiment, packer 30 is a hydraulically actuated packer that is also functionally connected to the control line 22. Thus, a change in the pressure in the control line 22 (such as an increase above or a decrease below the relevant threshold) results in the activation of packer 30.

In one embodiment, a plurality of packers 30 are deployed on tubing 16, each being hydraulically actuated via the relevant pressure change in the control line 22. Each packer 30 may be hydraulically actuated at different pressure levels, depending on the desires of the user (based on the sequence he/she wishes the packers to be set).

In one embodiment as shown in FIG. 10, wellbore 10 intersects a plurality of formations 14, and the packers 30 are placed so that they hydraulically isolate each formation 14. Each valve system 17 is then placed between two of the packers 30 thereby enabling a user to independently isolate and control the flow from each formation 14. With the use of the valve system 17 and indexers 20 of the present invention, a user can then select any of a variety of permutations of valve settings through the use of one control line enabling the strategic flow control of a plurality of regions or formations.

In another embodiment, a sensor system 32 is deployed within the wellbore 10. The sensor system 32 may sense or measure any of a variety of parameters, such as temperature, distributed temperature, pressure, distributed pressure, strain, flow, acceleration, chemical compositions, resistivity, oil content, water content, or gas content (to name a few).

In one embodiment, the sensor system 32 comprises a fiber optic sensor system, including an opto-electronic unit 36 and an optical fiber 34. The optical fiber 34 may be deployed within the control line 22. In one embodiment, the sensor system 32 comprises a fiber optic sensor system that measures distributed temperature along the length of the optical fiber 34, such as Sensor Highway Limited's DTS line of fiber optic distributed temperature sensors. In the DTS systems, the optical fiber 34 is deployed in the wellbore 10 and is connected to the opto-electronic unit 36 that transmits optical pulses into the optical fiber 34 and receives returned signals back from the optical fiber 34. The signal reflected from the optical fiber 34 and received by the opto-electronic unit 36 differs depending on the temperature at and distance to the originating point of the reflected signal. Sensor Highway's DTS system utilizes a technique called optical time domain reflectometry ("OTDR"), which detects Raman scattering to measure the temperature profile along the optical fiber as described in U.S. Pat. Nos. 4,823,166 and 5,592,282 issued to Hartog, both of which are incorporated herein by reference. It is understood that OTDR is not the only way to obtain a distributed temperature measurement (and this patent is therefore not limited to OTDR).

In one embodiment, the optical fiber 34 is injected into the control line 22 by way of fluid drag, as disclosed in U.S. Pat. No. Re 37,283, which patent is incorporated herein by reference. The optical fiber 34 may be injected into the control line 22 before, during, or after the control line 22 and tubing 16 are situated in the wellbore 10. In another embodiment, the control line 22 is a unshaped control line having an end that returns to the surface.

In operation, the control line 22 is typically attached to the tubing 16, and the tubing 16 is deployed in the wellbore 10. If used, the optical fiber 34 may be injected into the control line 22 as previously described before, during, or after deployment. Once the tubing 16 and valve systems 17 are in the correct position in relation to the wellbore 10 and the formation(s) 14, source 24 is activated to change the hydraulic pressure in the control line 22 to a level that activates and sets the packer(s) 30 (if any). In one embodiment, the activating pressure of such packer(s) are lower than that of the indexers 20 and valve systems 17. Next, a user can change or cycle through the pressure changes or cycles so as to arrange the settings of the flow control device 18 and indexers 20 as desired. If the user requires a change, the user may change the settings of the flow control devices 18 and indexers 20 by again changing or cycling the pressure to obtain the desired permutation of flow control device settings.

In another embodiment of the invention, a surface controller 100 functionally attached to the hydraulic pressure source 24, controls the cycling of pressure changes. The controller 100, which may comprise a computer, may keep track of the permutation of the pressure cycle. In one embodiment, the controller 100 automatically activates a pressure change to move the system 5 to the next permutation of settings based on certain events, such as timing or downhole characteristics sensed by sensors (like but not limited to the fiber optic line 34).

As previously disclosed, it should be understood that the system 5 can control the operation of any hydraulically actuated downhole tool 6, including but not limited to packers, flow control devices, perforating guns, safety valves, pumps, gas lift valves, anchors, bridge plugs, and sliding sleeves. Moreover, by using the present invention, any combination of downhole tools may be connected and controlled with the same control line.

Although only a few exemplary embodiments of this invention have been described in detail above, those skilled in the art will readily appreciate many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system usable with a wellbore, comprising:

a plurality of flow control devices deployed in the wellbore, each of the flow control devices having a plurality of states;

a hydraulic control line; and a plurality of indexers, each of the indexers being in fluid communication with the hydraulic control line and being functionally connected to a different one of the flow control devices;

wherein the indexers are configured to operate in concert in response to pressure in the hydraulic control line to select each of at least three different permutations of the states.

2. The system of claim 1, wherein at least one packer is in fluid communication with the control line and wherein the at least one packer is actuated by a change in pressure in the control line.

3. The system of claim 2, wherein a plurality of packers are in fluid communication with the control line and wherein the packers are actuated by a change in pressure in the control line.

4. The system of claim 3, wherein the packers hydraulically isolate a plurality of formations intersected by the wellbore.

5. The system of claim 4, wherein each flow control device is associated with a formation.

6. The system of claim 1, wherein at least a part of a sensor system is deployed in the control line.

7. The system of claim 6, wherein the sensor system comprises an optical fiber and the optical fiber is deployed in the control line.

8. The system of claim 7, wherein the sensor system senses distributed temperature.

9. The system of claim 1, wherein the indexers are adapted to operate in concert according to a predefined sequence of the permutations and advance the sequence from one permutation to the next permutation in response to the presence of a pressure stimulus in the hydraulic control line.

10. A system usable with a wellbore, comprising:

a plurality of downhole tools deployed in the wellbore, each downhole tool having a plurality of states;

a hydraulic control line; and a plurality of indexers, each of the indexers being in fluid communication with the hydraulic control line and being functionally connected to a different one of the downhole tools;

wherein the indexers are configured to operate in concert in response to pressure in the hydraulic control line to select each of at least three different permutations of the states.

11. The system of claim 10, wherein the downhole tools comprise at least one packer.

12. The system of claim 10, wherein the downhole tools comprise at least one flow control device.

13. The system of claim 10, wherein the downhole tools comprise at least one perforating gun.

14. The system of claim 10, wherein the downhole tools comprise at least one safety valve.

15. The system of claim 10, wherein at least a part of a sensor system is deployed in the control line.

16. The system of claim 15, wherein the sensor system comprises an optical fiber and the optical fiber is deployed in the control line.

17. The system of claim 16, wherein the sensor system senses distributed temperature.

18. The system of claim 10, wherein different pressure settings in the control line control line control a different one of the downhole tools.

19. The system of claim 10, wherein the indexers are adapted to operate in concert according to a predefined sequence of the permutations and advance the sequence from one permutation to the next permutation in response to the presence of a pressure stimulus in the hydraulic control line.

20. A method to control operations in a wellbore, comprising:

deploying a plurality of downhole tools in the wellbore;

providing a hydraulic control line;

functionally connecting an indexer to each downhole tool;

providing fluid communication between the hydraulic control line and each indexer;

controlling the downhole tools by causing the indexers to operate in concert to pressure in the hydraulic control line to select each of at least three different permutations of states of the downhole tools.

21. The method of claim 20, wherein the plurality of downhole tools comprise a plurality of flow control devices and wherein the act of controlling comprises changing the state of at least one of the flow control devices by changing the pressure in the hydraulic control line.

22. The method of claim 21, wherein the act of changing the state comprises providing fluid communication to a formation.

23. The method of claim 20, wherein the act of controlling comprises automatically controlling the change in pressure in the hydraulic control line.

24. The method of claim 23, wherein the act of automatically controlling comprises automatically controlling the change in pressure based on an event.

25. The method of claim 24, wherein the act of controlling the change in pressure based on an event comprises sensing a downhole characteristic.

26. The method of claim 20, further comprising:

causing the indexers to follow a controlled sequence of the permutations; and advancing the sequence from one permutation to the next permutation in response to a pressure stimulus being communicated through the hydraulic control line.

27. A method to control operations in a wellbore, the method comprising:

deploying a plurality of downhole tools in the wellbore;

providing a hydraulic control line;

functionally connecting a respective indexer to each downhole tool;

providing fluid communication between the hydraulic control line and each indexer; and controlling the downhole tools by causing the indexers to operate in concert to pressure in the hydraulic control line to select each of at least three different permutations of states of the downhole tools.

28. The method of claim 27, further comprising:

causing the indexers to follow a controlled sequence of the permutations; and advancing the sequence from one permutation to the next permutation in response to a pressure stimulus being communicated through the hydraulic control line.

29. The method of claim 27, wherein the plurality of downhole tools comprise a plurality of flow control devices and wherein the controlling step comprises changing the state of at least one of the flow control devices by changing the pressure in the hydraulic control line.

30. The method of claim 29, wherein the changing the state step comprises providing fluid communication to a formation.

31. The method of claim 27, wherein the controlling step comprises automatically controlling the change in pressure in the hydraulic control line.

32. The method of claim 31, wherein the automatically controlling step comprises automatically controlling the change in pressure based on an event.

33. The method of claim 32, wherein the event comprises sensing a downhole characteristic.

* * * * *